United States Patent [19]

German

[11] 4,237,918

[45] Dec. 9, 1980

[54] UNLOADER AND CHECK VALVE

[75] Inventor: Dale F. German, Roxboro, N.C.

[73] Assignee: Eaton Corporation, Cleveland, Ohio

[21] Appl. No.: 40,803

[22] Filed: May 21, 1979

[51] Int. Cl.[3] ..... G05D 11/00

[52] U.S. Cl. ..... 137/116; 417/299

[58] Field of Search ..... 417/299, 307; 137/116, 137/117

[56] References Cited

U.S. PATENT DOCUMENTS

| | | | |
|---|---|---|---|
| 3,195,319 | 7/1965 | Wolff | 137/116 |
| 3,358,705 | 12/1967 | Krechel | 137/116 |
| 3,545,887 | 12/1970 | Kobnick | 417/307 |
| 3,606,908 | 9/1971 | Riester | 137/116 |
| 3,999,568 | 12/1976 | Chapman | 417/299 |
| 4,061,271 | 12/1977 | Kimbrough | 417/307 |
| 4,114,637 | 9/1978 | Johnson | 137/116 |

*Primary Examiner*—Martin P. Schwadron
*Assistant Examiner*—H. Jay Spiegel
*Attorney, Agent, or Firm*—R. J. McCloskey; F. M. Sajovec, Jr.

[57] ABSTRACT

A combined unloader and check valve for use with a motor driven air compressor (70) in which pressure trapped in the compressor head when the compressor is shut down is unloaded by means of an unloaded valve element (44) which opens a port (26) to unload the head pressure to atmosphere through an exhaust port (62) in response to the closing of a check valve element (34) in the compressor outlet line. When the compressor is operating and the check valve is open, pressure above the unloading valve element keeps the unloading valve element in position to shut off flow through the exhaust port. Air trapped above the unloader valve element when the check valve is initially closed is bled off through a filter element (52). In a preferred embodiment of the invention, the unloader valve element (144) is in the form of a diaphragm. The filter element (52) can be a compressible material to permit adjustment of the bleed rate therethrough by varying the density thereof by means of an adjustable bleed screw (48).

7 Claims, 2 Drawing Figures

UNLOADER AND CHECK VALVE

Figure 1:
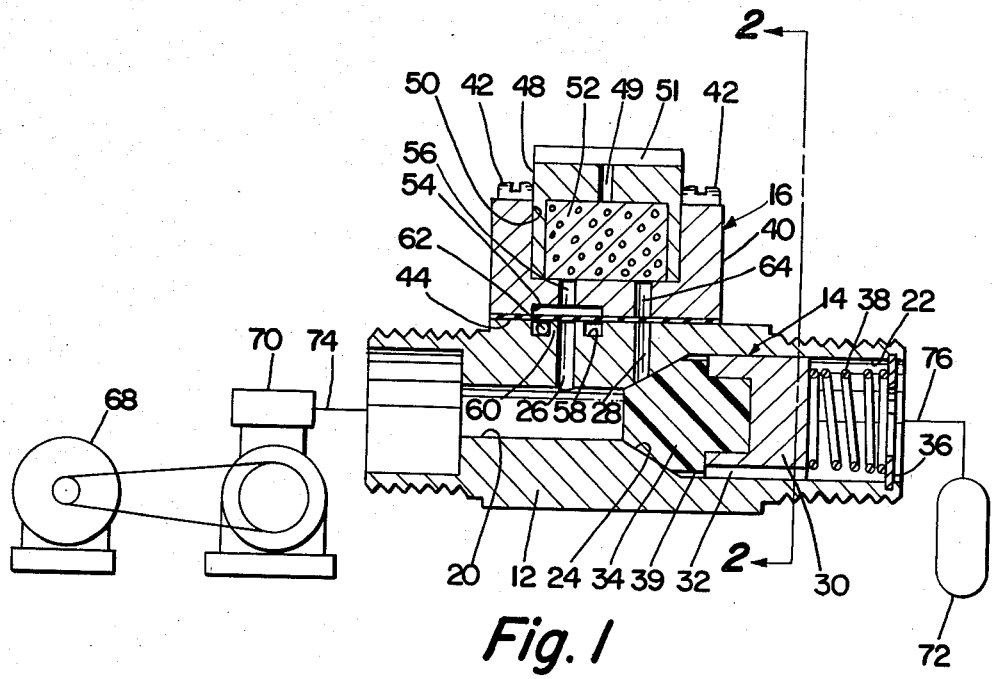

The present invention relates to unloaders for air compressors, and particularly to a combined unloader and check valve for use with a motor driven air compressor.

When an air compressor is shut down the compressor head will remain pressurized unless the pressure is relieved by some means. In a motor driven compressor, if this pressure is not relieved or bled off before the compressor is restarted, the motor will tend to stall.

It is known to provide an unloading device which relieves the head pressure when the compressor is turned off such that when the compressor is restarted a relatively small load is imposed on the motor until the motor gets up to operating speed. Such known devices, however, generally include open bleed passages which tend to bleed excessive air when the compressor is operating, or which become clogged and inoperative. If the compressor is a piston type, such known unloading devices tend to exhaust to atmosphere upon completion of each pressure pulse by the compressor.

It is an object of the present invention to provide an unloading device for an air compressor, which is simple and reliable, and which can be produced at a reasonable cost.

Another object of the invention is to provide an unloading valve having bleeding means which will not tend to become clogged, and in which the bleed rate is controlled to function efficiently to relieve compressor head pressure when the compressor is shut down without bleeding off an excessive amount of pressurized air when the compressor is operating.

Another object of the invention is to provide an unloading valve which will not exhaust to atmosphere at the completion of every pressure pulse during normal operation of a piston type compressor.

Another object of this invention is to provide an unloading valve as above in combination with a check valve installed between the compressor output and a tank.

To meet the above objectives, the present invention provides a combined check valve and unloading valve in which an unloading port is controlled by the opening and closing of a main check valve poppet. When the check valve is open, pressure acts on one side of an unloading valve element to close an unloading exhaust port. When the check valve is closed, the pressure above the unloading valve element is bled off through a filter element to permit the unloading valve element to open the exhaust port to relieve the pressure on the compressor head. The bleed rate is such that there is a time lag between shut down of the compressor and opening of the exhaust port, so that the exhaust port will not open at the end of each pressure pulse when the valve is used with a piston type compressor. The bleed rate can be continuously controlled by providing a compressible filter element and controlling the degree to which the filter element is compressed.

Figure 2:
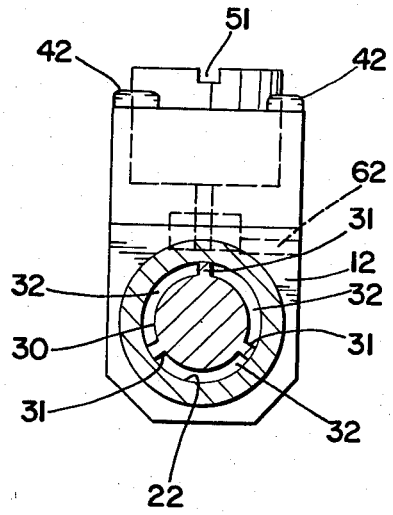

Other objects and advantages of the invention will be apparent from the following description when taken in connection with the accompanying drawings, wherein:

FIG. 1 is a cross sectional view of the invention as employed in an air compressor system; and FIG. 2 is a sectional view taken along line 2—2 of FIG. 1.

Referring to the drawings, there is illustrated an unloader and check valve designated generally by the numeral 10, comprising a valve body 12, a check valve assembly 14 received in the valve body, and an unloader valve assembly 16 attached to the valve body.

The valve body 12 has a series of interconnected longitudinal bores formed therethrough including a first inlet bore 18, a second reduced diameter bore 20, and a third outlet bore 22. The intersection of the second and third bores is defined by a tapered section which forms a conical valve seat surface 24. A first transverse port 26 is formed in the body 12 intersecting the bore 20, and a second transverse bore 28 is formed in the body and intersects the through bore at the valve seat surface 24.

The poppet valve assembly 14 comprises a generally cylindrical plunger member 30 having a plurality of axial projections or ribs 31 formed thereon to define an outer diameter which provides a sliding fit within bore 22, and a plurality of axial passages 32 between the plunger and the bore; a resilient poppet member 34 received in a counterbore formed in the inner end of plunger 30 and bonded or otherwise fastened thereto; an annular spring retainer 36 received in a groove formed in the bore 22; and a spring 38 which acts between the plunger 30 and the spring retainer 36, and which biases the poppet member 34 against the valve seat surface 24. The poppet member 34 can be formed of rubber or a suitable elastomeric material and has a frusto-conical surface formed on its free end to conform to the valve seat surface. The maximum diameter of the poppet member 34 is somewhat smaller than the bore 22 to define an annular passage 39 around the poppet member and in communication with the passage 32.

The unloader assembly 16 comprises a housing 40 which can be bolted to the valve body 12 by means of bolts 42, a diaphragm 44 clamped between the valve body and the unloader assembly, an inverted cup shaped bleed adjusting screw 48 which is threadedly received in a counterbore 50 formed in the housing 40, and a cylindrical filter element 52 which is received within the bleed screw 48. The filter element 52 can be formed of a fibrous or cellular material which, in its free state, is somewhat longer than the interior of the bleed screw, such that the filter element is compressed when the screw is threaded into the housing 40. The bleed screw 48 has a bleed port 49 formed through the base thereof, and a screwdriver slot 51 can be formed in the base to facilitate adjustment. The rate at which air can bleed through the port 49 is controlled after the valve is installed by the degree to which the filter element is compressed as the screw 48 is threaded into the housing.

The filter element 52 can also be formed of a rigid material such as sintered bronze or the like, in which case the bleed rate therethrough will be nonadjustable.

A counterbore 54 is formed in the diaphragm-engaging surface of the housing 40, and a bleed passage 56 is formed in the housing connecting the counterbores 50 and 54. An annular depression 58 is formed around the port 26 in valve body 12 to define a valve seat 60. The diaphragm 44 overlies the valve seat 60 to define an unloader valve element. The counterbore overlies the annular depression 58, and the relative pressure conditions in the chamber defined on one side of the diaphragm 44 by the counterbore 54 and in the chamber defined by the depression 58 on the other side of the diaphragm act on the diaphragm to open and close the port 26.

An exhaust port 62 intersects the annular depression 58 and extends outward of the valve body 12 as shown in FIG. 2.

A control port 64 is formed in the housing 40 in alignment with the port 28 in valve body 12 and connects the port 28 to the counterbore 50. In the embodiment illustrated the diaphragm 44 extends between the port 28 and 64 and a hole is formed therein to maintain open communication between the ports.

In operation, the valve 10 is installed in a system, as shown schematically in FIG. 1, which includes a motor 68 driving an air compressor 70, and a storage tank 72. The outlet of the compressor is connected to the inlet bore 18 of the valve 10 via line 74, and the inlet of the storage tank is connected to the outlet bore 22 of the valve 10 via line 76.

When the motor 68 is energized, compressed air flows from the compressor 70, through line 74, valve 10, and line 76 to the tank 72. When air enters the valve 10 and the pressure builds up to a point wherein the pressure force acting on the poppet member 34 is sufficient to overcome the preload of spring 38, the poppet assembly 14 will move to the right as shown to open a flow path through the valve to tank. When the poppet opens, air is allowed to enter the counterbore 54 via ports 28 and 64, the filter element 52 and passage 56. Since the exhaust port 62 opens directly to atmosphere, pressure in counterbore 54 acting against the diaphragm 44 forces the diaphragm into engagement with the unloader valve seat 60, thus blocking port 26. The size of the bleed port 49, and the density of the filter element 52 are selected such that the bleed rate through port 49 will not be so high as to prevent the pressure in counterbore 54 above the diaphragm from building up sufficiently to keep the port 26 closed while the compressor is in operation.

When the compressor stops, air flow through the valve stops, thus allowing the poppet assembly 14 to move to the left, shutting off flow through the valve, and blocking port 28. Air trapped in the counterbore 54 above the diaphragm 44 will bleed through passage 56, through the filter element 52 and out port 49 to permit the air trapped in the compressor head to cause diaphragm 44 to lift off the valve seat 60, thus allowing the compressor head pressure to bleed off through the exhaust port 62. The filter element 52 prevents foreign matter from clogging the bleed path.

The controlled bleed rate through port 49 results in a time lag between shut down of the compressor and opening of the exhaust port 62. Thus when the valve is used with a piston type compressor, it will not exhaust to atmosphere at the completion of every pressure pulse during normal operation of the compressor.

When the compressor is restarted, air will initially bleed off through port 26 and the exhaust port 62, thus imposing a relatively light load on the motor 68 until the air flow is sufficient to move the poppet member 34 off its seat, causing the diaphram to close port 26 and allowing the compressed air to flow to the tank 72 as described above.

I claim:

1. A valve comprising a body having an inlet passage and an outlet passage formed therein; check valve means in said body between said inlet and outlet passage and movable between an open position when flow is from said inlet passage to said outlet passage, and a closed position when flow is from said outlet passage to said inlet passage; a control chamber formed in said body; a diaphragm dividing said control chamber into first and second chambers; a first conduit connecting said inlet passage with said first chamber; a second conduit connecting said first chamber to atmosphere; and means defining a valve seat at the intersection of said first conduit and said first chamber, said diaphragm being engageable with said valve seat and movable between a first position closing communication between said first and second conduits in response to opening of said check valve means and a second position opening communication between said first and second conduits in response to closing of said check valve means said valve further including means defining a flow path between said second chamber and said outlet passage including control passage means opened when said check valve means is open and closed when said check valve means is closed.

2. Apparatus as claimed in claim 1, including means connecting said second chamber to atmosphere comprising a first bleed passage opening into said second chamber, a second bleed passage connecting said first bleed passage to atmosphere, and a filter element in series between said first and second bleed passages.

3. Apparatus as claimed in claim 2, including a cup-shaped cylindrical member attached to said body with its open end in communication with said first bleed passage, said second bleed passage being defined by an orifice formed in the base of said cup-shaped member, and said filter element being received in said open end.

4. Apparatus as claimed in claim 3 in which said cylindrical member is threadedly received in a counterbore formed in said body, and said filter element comprises a compressible material.

5. Apparatus as claimed in claim 4 in which said filter element is larger in volume in its free state than the interior volume of said cylindrical member, said filter element being compressed when said cylindrical member is threaded into said counterbore.

6. Apparatus as claimed in claim 2, in which said check valve means comprises a conical valve seat formed in said body connecting said inlet and outlet passages, a conical valve element disposed in said outlet passage and engageable with said conical valve seat, and means biasing said conical valve element into engagement with said conical valve seat, said control passage means comprising a bore formed in said body and intersecting said conical valve seat.

7. Apparatus as claimed in claim 6, including a cup-shaped cylindrical member attached to said body with its open end in communication with said first bleed passage and with said control passage, said second bleed passage being defined by an orifice formed in the base of said cup-shaped member, and said filter element being received in said open end.

* * * * *